United States Patent [19]

Heller

[11] Patent Number: 4,490,150

[45] Date of Patent: Dec. 25, 1984

[54] USE OF POLYOXYALKYLATED ALKYL PHENOLS AS DYEING ASSISTANTS FOR DISPERSE DYES

[75] Inventor: Juerg Heller, Bottmingen, Switzerland

[73] Assignee: Sandoz Ltd., Basel, Switzerland

[21] Appl. No.: 463,461

[22] Filed: Feb. 3, 1983

[30] Foreign Application Priority Data

Feb. 3, 1982 [DE] Fed. Rep. of Germany ..... 3203650

[51] Int. Cl.[3] ..... D06P 1/61; D06P 3/42

[52] U.S. Cl. ..... 8/610; 8/613; 252/8.9

[58] Field of Search ..... 8/610, 613; 252/8.9

[56] References Cited

U.S. PATENT DOCUMENTS

| | | | |
|---|---|---|---|
| 3,236,583 | 2/1966 | Hees | 8/55 |
| 3,994,680 | 11/1976 | Mueller et al. | 8/613 |
| 4,233,026 | 11/1980 | Hitschfel et al. | 8/524 |
| 4,255,152 | 3/1981 | Hewitt et al. | 8/610 |
| 4,340,382 | 7/1982 | Morlino et al. | 8/137 |
| 4,345,910 | 8/1982 | Vescia et al. | 8/610 |
| 4,373,930 | 2/1983 | Rothwell | 8/610 |

FOREIGN PATENT DOCUMENTS

| | | |
|---|---|---|
| 49-81685 | 8/1974 | Japan . |
| 1256609 | 12/1971 | United Kingdom . |

OTHER PUBLICATIONS

Chemical Abstracts, vol, 82, (1975), p. 66 74352f Japanese Kokai 74 81,685.

*Primary Examiner*—A. Lionel Clingman

*Attorney, Agent, or Firm*—Gerald D. Sharkin; Richard E. Vila; Thomas C. Doyle

[57] ABSTRACT

A process for shifting the equilibrium of disperse dyestuffs between an aqueous liquor and a textile substrate comprising adding to the aqueous liquor a compound of formula I

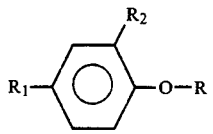

I wherein $R_1$ and $R_2$, independently, are hydrogen or $C_{4-12}$-alkyl, provided that $R_1$ and $R_2$ are not both hydrogen;

R is a mixed chain containing from 7 to 31 ethyleneoxy and 3 to 27 propyleneoxy units, with the proviso that R contains at most a total of 34 units.

22 Claims, No Drawings

USE OF POLYOXYALKYLATED ALKYL PHENOLS AS DYEING ASSISTANTS FOR DISPERSE DYES

The present invention relates to dyeing assistants for dyeing or printing with disperse dyes or for lightening or stripping disperse dyeings or printings.

The invention provides a process for shifting the equilibrium of disperse dyestuffs between an aqueous liquor and a textile substrate comprising adding to the aqueous liquor a compound of formula I

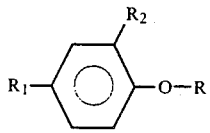

I wherein $R_1$ and $R_2$, independently, are hydrogen or $C_{4-12}$alkyl, provided that $R_1$ and $R_2$ are not both hydrogen;

R is a mixed chain containing from 7 to 31 ethyleneoxy and 3 to 27 propyleneoxy units, with the proviso that R contains at most a total of 34 units.

Any alkyl as $R_1$ or $R_2$ may be branched or straight chain. Preferred alkyl groups are $C_{4-10}$alkyl, particularly tert.butyl, octyl, iso-octyl or nonyl, more particularly iso-octyl or nonyl. $R_2$ is preferably hydrogen. $R_1$ is preferably alkyl.

R is preferably an ordered chain of a block of ethyleneoxy units followed by a block of propyleneoxy units or an ordered chain of a block of propyleneoxy units followed by a block of ethyleneoxy units or an ordered chain of 2 blocks of propyleneoxy units separated by one block of ethyleneoxy units, the indicated order of each chain beginning from the phenoxy moiety.

Preferably R contains from 7 to 18, preferably 7 to 12 ethyleneoxy units. The total number of propyleneoxy units present in R is preferably from 3 to 16, more preferably from 4 to 10.

Preferred compounds of formula I are those wherein $R_1$ is $C_{6-10}$alkyl, preferably iso-octyl or nonyl, especially nonyl, $R_2$ is hydrogen and R is an ordered chain of 7 to 18, preferably 7 to 12, especially 8, ethyleneoxy units and 3 to 16, preferably 4 to 10, especially 6, propyleneoxy units.

Compounds of formula I may be produced by known methods, for example by condensing the corresponding mono- or dialkyl phenol or a mixture thereof, with ethyleneoxide and propyleneoxide in the desired sequence. The condensation is conveniently carried out in the presence of a catalyst such as an alkali metal or an alkali metal hydroxide at temperatures of from 140° to 180° C., preferably 150° to 160° C. Preferably the condensation is effected in the absence of a solvent.

The compounds of formula I are useful as agents for shifting the dyestuff equilibrium between the liquor and the textile substrate. When used in suitable, preferably small, quantities the compounds of formula I are capable of shifting the equilibrium in favour of the liquor to the extent that the adsorption of the disperse dyes onto the fibres is retarded. In this case, the dyeing assistants of formula I are used during the dyeing, padding or printing process and have a notable levelling effect. They are added to the dyebath, the padding liquor or the printing paste in amounts generally ranging from 0.5 to 5 g/l, preferably from 1 to 3 g/l. The dyeings and printings thus achieved have a good levelness and their fastness properties are not impaired.

The compounds of formula I are preferably used for exhaust dyeing, more preferably under high temperature conditions (100°–140° C.). The dyebath may contain further assistants, e.g. one or more dispersing agents, preferably anionic dispersing agents.

The compounds of formula I, especially when used in larger quantities are capable of reversing the dyeing process so that the dyestuff is removed from the dyed fibre. In this case, the compounds of formula I have a lightening or a stripping effect on the disperse dyeings or printings. The textile substrate dyed or printed with disperse dyes is treated with a liquor containing a compound of formula I according to the known lightening or stripping methods. Depending on the desired effect, the compounds of formula I may be used in an amount ranging, for example, from 2 to 100 g/l, preferably from 6 to 100 g/l.

According to a preferred embodiment of the invention, the compounds of formula I are used as levelling agents for dyeing with disperse dyes and are added to the dyebath, padding liquor and printing paste. Preferably the compounds of formula I are used in admixture with one or more anionic dispersing agents, e.g. an at least partially carboxymethylated condensation product of a $C_{4-15}$alkyl- or di($C_{4-15}$alkyl)-phenol with 5 to 50 mols alkylene oxide, preferably ethylene oxide, sulphonated diphenyl or ditolyl ether, sulphonated alkyl$C_{4-15}$benzene or sulphonated castor oil. Mixtures of one or more compounds of formula I with one or more anionic dispersing agents form part of the invention. In such mixtures, the weight ratio of the anionic dispersing agent to the compound of formula I is 0.1–1:1, preferably 0.2–0.5:1.

Suitable textile substrates which may be dyed or printed according to the invention are those consisting of or comprising synthetic or semi-synthetic hydrophobic, high molecular weight organic textile materials, e.g. polyester, cellulose triacetate and cellulose 2½ acetate, especially linear, aromatic polyester.

The following Examples further serve to illustrate the invention. In the Examples all parts and percentages are by weight and all temperatures in degrees Centigrade.

EXAMPLE 1

150 parts (1 mol) 4-tert.-butylphenol and 2 parts sodium hydroxide are heated to 160° C. under a nitrogen atmosphere. 308 parts (7 mols) ethylene oxide are then introduced at the same temperature at such a rate that the reaction is complete after one hour. Subsequently, 232 parts (4 mols) propyleneoxide are added dropwise at 150° over 2 hours to the reaction mixture.

After cooling and the addition of 3 parts glacial acetic acid, there are obtained about 693 parts of a brown liquid which has a cloud point at 32° when diluted to 1% with water.

By following the same procedure and reacting 1 mol phenol with first ethyleneoxide and then propyleneoxide there are obtained the compounds of formula I indicated in the Table below.

TABLE

| Ex. | 1 Mol Phenol | Parts | Ethylene-oxide Parts | Ethylene-oxide Mols | Propylene-oxide Parts | Propylene-oxide Mols | Resulting product Parts | Resulting product cloud point |
|---|---|---|---|---|---|---|---|---|
| 2 | 4-tert. Butyl-phenol | 150 | 528 | 12 | 464 | 8 | 1145 | 39° |
| 3 | 4-tert. Butyl-phenol | 150 | 704 | 16 | 812 | 14 | 1669 | 32° |
| 4 | 4-Isooctyl-phenol | 206 | 352 | 8 | 232 | 4 | 792 | 32° |
| 5 | 4-Isooctyl-phenol | 206 | 704 | 16 | 812 | 14 | 1724 | 42° |
| 6 | 4-Nonyl-phenol | 220 | 308 | 7 | 232 | 4 | 763 | 28° |
| 7 | 4-nonyl phenol | 220 | 352 | 8 | 348 | 6 | 922 | 32° |
| 8 | 4-nonyl phenol | 220 | 440 | 10 | 464 | 8 | 1126 | 41° |
| 9 | 4-nonyl-phenol | 220 | 660 | 15 | 1044 | 18 | 1926 | 37° |
| 10 | 2,4-Dinonyl-phenol | 346 | 880 | 20 | 580 | 10 | 1809 | 48° |

EXAMPLE 11

220 Parts (1 mol) nonylphenol are reacted at 160° in the presence of 2 parts sodium hydroxide as catalyst first with 174 parts (3 mols) propyleneoxide, then with 440 parts (10 mols) ethyleneoxide and finally with 290 parts (5 mols) propyleneoxide.

1126 Parts of a compound having a cloud point at 44° (diluted to 1% with water) is thus obtained.

EXAMPLE 12

A polyester fabric is dyed in a HT-laboratory dyeing machine with a dyebath containing 0.5 g/l of the dye C.I. Disperse Blue 73 (Constitution No. 63265) and 1 g/l of the compound of Example 7 and adjusted with acetic acid to pH 5. The goods to liquor ratio is 1:20. The temperature of the dyebath is raised to 130° at a heating rate of 3°/min.

A blue dyeing with an excellent levelness is thus obtained.

EXAMPLE 13

Polyester cross-wound bobbins are dyed under high temperature conditions with 2% of the dye C.I. Disperse Red 72 (Constitution No. 111 114), at a goods to liquor ratio of 1:15. The dyebath which circulates at a rate of 30 l/kg/min contains 1 g/l of the compound of Example 8 and 0.5 g/l of a commercially available dispersing agent or a mixture of dispersing agents (e.g. based on an ethoxylated, carboxymethylated mono- or di[$C_{4-15}$alkyl]phenol or a sulphonated diphenyl ether) and is adjusted to pH 5 with ammonium sulphate and formic acid. The dyebath is heated to 130° at a rate of 3°/min.

The resulting red dyeing has an excellent levelness.

EXAMPLE 14

Polyester knitted goods which have previously been unequally dyed with 2% of C.I. Disperse Red 73 (Constitution No. 11116) are treated for 30 minutes at 130° with a bath containing 2 g/l of the compound of Example 8 and adjusted to pH 5 with acetic acid. The goods to liquor ratio of 1:20.

By this treatment, the dyeing becomes lighter and also level.

EXAMPLE 15

A polyester fabric which has previously been dyed with (a) 0.625% of the commercially available C.I. Disperse Red 73 or (b) 0.65% of the commercially available C.I. Disperse Blue 183 is treated for 1 hour at 130° with the compound of Example 7. The goods to liquor ratio is 1:40 and the treatment bath is adjusted to pH 5. The following stripping or lightening effects are obtained for the various amounts of compound of Example 7.

| | Amount Comp. Ex. 7 g/l | Lightening effect (original dyeing = 100 %) |
|---|---|---|
| dye a | 2 | 80% |
| | 4 | 71% |
| | 6 | 65% |
| | 10 | 56% |
| dye b | 2 | 88% |
| | 4 | 77% |
| | 6 | 72% |
| | 10 | 62% |

These results have been assessed in % of the dye applied on the substrate measured through the remission.

EXAMPLE 16

A polyester fabric dyed with 2 g/l of the commercially available C.I. Disperse Blue 183 is padded at room temperature with a bath containing 30, 50 or 100 g/l of the compound of Example 7, to a pick-up of 100% based on the dry weight. The substrate is then dried at 130° for 60 minutes and subsequently treated for 2 minutes at 220° for fixation. The resulting "stripping" effect is evaluated in notes in comparison with an undyed substrate according to the Grey Scale: for 30 g/l of the compound of Example 7 the note is 1.8, for 50 g/l the note is 2.4 and for 100 g/l, the note is 3.3.

What is claimed is:

1. In a process wherein a textile substrate is dyed or printed with an aqueous dyebath, aqueous padding liquor or aqueous printing paste containing a disperse dyestuff or wherein a textile substrate dyed or printed with a disperse dye is lightened or stripped in an aqueous liquor, the improvement which comprises having present in the aqueous medium, in an amount sufficient to shift the equilibrium of the disperse dyestuff between the aqueous medium and the substrate in favor of the aqueous medium, a compound of formula I

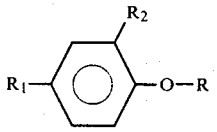

I wherein one of $R_1$ and $R_2$, is hydrogen or $C_{4-12}$alkyl, and the other is $C_{4-12}$alkyl, and R is an ordered chain of a block of 7 to 18 ethyleneoxy units followed by a block of 3 to 16 propyleneoxy units beginning from the phenoxy moiety.

2. A process according to claim 1 wherein the aqueous medium is a dyebath, padding liquor or printing paste containing the compound of formula I in an amount of 0.5 to 5 g/l.

3. A process according to claim 1 wherein the aqueous medium is an aqueous liquor in whch a dyed or printed textile substrate is lightened or stripped and which contains the compound of formula I in an amount of 2 to 100 g/l.

4. A process according to claim 1 wherein R contains 7 to 12 ethyleneoxy units and 4 to 10 propyleneoxy units.

5. A process according to claim 2 wherein R contains 7 to 12 ethyleneoxy units and 4 to 10 propyleneoxy units.

6. A process according to claim 4 wherein $R_1$ is $C_{4-10}$alkyl and $R_2$ is hydrogen.

7. A process according to claim 5 wherein $R_1$ is $C_{4-10}$alkyl and $R_2$ is hydrogen.

8. A process according to claim 2 wherein the compound of formula I is in admixture with an anionic dispersing agent in a weight ratio of dispersing agent:compound of formula I of 0.1:1 to 1:1.

9. A process according to claim 7 wherein the compound of formula I is in admixture with an anionic dispersing agent in a weight ratio of dispersing agent: compound of formula I of 0.1:1 to 1:1.

10. A process according to claim 8 wherein the anionic dispersing agent is a carboxymethylated condensation product of a mono- or di-($C_{4-15}$alkyl)phenol with 5 to 50 mols alkylene oxide, a sulphonated diphenyl, a sulphonated ditolyl ether, a sulphonated alkyl$C_{4-15}$benzene or a sulphonated castor oil.

11. A process according to claim 2 wherein in the compound of formula I, $R_1$ is nonyl, $R_2$ is hydrogen, and R is an ordered chain of a block of 8 ethyleneoxy units followed by a block of 6 propyleneoxy units.

12. A process according to claim 2 in which the aqueous medium is a dyebath in which the textile substrate is exhaust dyed at a temperature of 100° to 140° C.

13. A process according to claim 7 in which the aqueous medium is a dyebath in which the textile substrate is exhaust dyed at a temperature of 100° to 140° C.

14. A process according to claim 1, in which in formula I $R_2$ is hydrogen.

15. A process according to claim 14, in which in formula I $R_1$ is iso-octyl or nonyl and R is a chain of 8 ethyleneoxy units followed by 6 propyleneoxy units.

16. A process according to claim 1, in which the textile substrate consists of or comprises synthetic or semi-synthetic hydrophobic, high molecular weight organic textile material.

17. A composition comprising one or more compounds of formula I

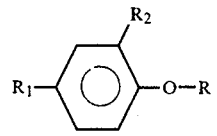

I wherein one of $R_1$ and $R_2$, is hydrogen or $C_{4-12}$alkyl, and the other is $C_{4-12}$alkyl, and R is an ordered chain of a block of 7 to 18 ethyleneoxy units followed by a block of 3 to 16 propyleneoxy units beginning from the phenoxy moiety and one or more anionic dispersing agents.

18. A composition according to claim 17 wherein the anionic surfactant is selected from the group consisting of carboxymethylated condensation products of mono- and di-($C_{4-15}$alkyl)phenols with 5 to 50 mols of alkylene oxide, sulphonated diphenyls, sulphonated ditolyl ethers, sulphonated alkyl$C_{4-15}$benzenes, sulphonated castor oils and mixtures thereof.

19. A composition according to claim 17 in which the weight ratio of anionic dispersing agent:compound of formula I is 0.1:1 to 1:1.

20. A composition according to claim 18 in which the weight ratio of anionic dispersing agent:compound of formula I is 0.1:1 to 1:1.

21. A composition according to claim 19 wherein, in the compound(s) of formula I, $R_1$ is $C_{4-10}$alkyl, $R_2$ is hydrogen and R contains 7 to 10 ethyleneoxy units and 4 to 10 propyleneoxy units.

22. A composition according to claim 21 wherein $R_1$ is nonyl and R is a block of 8 ethyleneoxy units followed by a block of 6 propyleneoxy units.

* * * * *